US006299047B1

(12) United States Patent
Ghibely et al.

(10) Patent No.: US 6,299,047 B1
(45) Date of Patent: Oct. 9, 2001

(54) STAPLER

(75) Inventors: Bruno Ghibely; Hans Willenbrock; Werner Taubken, all of Lingen (DE)

(73) Assignee: Erwin Mueller GmbH & Co, Lingen (DE)

( * ) Notice: Subject to any disclaimer, the term of this patent is extended or adjusted under 35 U.S.C. 154(b) by 0 days.

(21) Appl. No.: 09/410,831

(22) Filed: Oct. 1, 1999

(30) Foreign Application Priority Data

Oct. 1, 1998 (DE) ..... 198 49 093

(51) Int. Cl.[7] ..... B25C 5/02
(52) U.S. Cl. ..... 227/134; 227/121; 227/155
(58) Field of Search ..... 227/134, 121, 227/110, 155, 126, 124, 120

(56) References Cited

U.S. PATENT DOCUMENTS

| | | | | |
|---|---|---|---|---|
| 1,287,583 | * | 12/1918 | Greenfield | 227/155 |
| 1,959,888 | * | 5/1934 | Wilkins | 227/124 |
| 1,971,145 | * | 8/1934 | Liebowitz | 227/155 |
| 2,042,958 | * | 6/1936 | Pankonin | 227/121 |
| 2,059,020 | * | 10/1936 | Pankonin | 227/155 |
| 2,059,021 | * | 10/1936 | Pankonin | 227/121 |
| 2,096,371 | * | 10/1937 | Cavanagh | 227/121 |
| 2,103,551 | * | 12/1937 | Pankonin | 227/121 |
| 2,131,473 | * | 9/1938 | Drypolcher | 227/134 |
| 2,140,592 | * | 12/1938 | Pankonin | 227/155 |
| 2,227,826 | * | 1/1941 | Drypolcher et al. | 227/155 |
| 2,267,719 | * | 12/1941 | Crosby | 227/121 |
| 2,267,990 | * | 12/1941 | Obstfeld et al. | 227/121 |
| 2,378,725 | * | 6/1945 | Paul | 227/155 |
| 2,667,637 | * | 2/1954 | Marano | 227/121 |
| 2,798,219 | * | 7/1957 | Maynard | 227/134 |
| 2,922,163 | * | 1/1960 | Smick | 227/134 |
| 3,083,367 | * | 4/1963 | Ruskin | 227/134 |
| 3,398,872 | * | 8/1968 | Monahan | 227/110 |
| 3,451,606 | * | 6/1969 | Jacobson | 227/110 |
| 3,477,628 | * | 11/1969 | MacEachron | 227/110 |

FOREIGN PATENT DOCUMENTS

| | | | | |
|---|---|---|---|---|
| 810237 | * | 12/1936 | (FR) | 227/134 |
| 642064 | * | 8/1950 | (GB) | 227/120 |

* cited by examiner

*Primary Examiner*—Scott A. Smith
(74) *Attorney, Agent, or Firm*—Herbert L. Lerner; Laurence A. Greenberg; Werner H. Stemer

(57) ABSTRACT

A stapler, optionally used for flat-clinch stapling or for external and internal stapling, includes a stapling plate with stampings and a slit-like perforation for flat-clinch stapling. The stapling plate is rotatable or slidable or divided. The stapling plate has projecting outer gripping edges. The stapling plate folding part is pivotably connected to the base plate and includes a clip connection. The stapler upper part is slidingly and pivotably mounted. The sliding pivoting mount is a connecting pivot and a bearing block having a slot, the bearing block slidingly and pivotably mounted in the slot on the connecting pivot. The distance of the two end positions of the connecting pivot corresponds to the distance between the slit-like perforation and the stampings. The base plate is connected to the upper part by a yaw pivot bearing and the slit-like perforation and the shaped stampings are in line with each other, the pivoting upper part adapted to engage a staple with both. The yaw pivot bearing has latching positions and can be lifted from one position to another. The stapler includes two corresponding latching members, the first is on the base plate and the second is on a bearing block.

22 Claims, 6 Drawing Sheets

STAPLER

BACKGROUND OF THE INVENTION

FIELD OF THE INVENTION

The invention relates to a stapler having a magazine and staples guided therein under spring tension and fed thereby to an ejection channel. The staple located in the region of the ejection channel is thrust out of the ejection channel and through the material to be stapled by a thrust blade. The legs of the staple are bent when the thrust blade ejects the staple against a stapling material support having a slit-like perforation and an apparatus for flat-clinch stapling, both of which are located below the ejection channel.

In flat-clinched stapling, staple legs penetrate vertically through the material to be stapled and, subsequently, are bent over at right angles. In other words, the free lengths of the legs are bent over virtually parallel into the plane of the material to be stapled.

U.S. Pat. No. 5,516,025 to Eriksson discloses a generic type stapler described above. The stapler possesses a stapling material support with a slit-like perforation having n associated apparatus for flat-clinch stapling. These staplers have proved their value, as have the staplers whose stapling plates have shaped stampings on their upper sides for legs of the ejected staples. Such a stapler is disclosed, for example, in German Published, Non-Prosecuted Patent Application 21 19 484.

The configuration has a disadvantage that the staple legs are given a curved shape in the stamping after passing through the stapling material. As a result of their shape, the legs bent over below the stapled material protrude, creating undesirable protrusions when the stapled material is placed in a file. Although the defect is absent in flat-clinch stapling, flat-clinch stapling is unsuitable for the stapling material of relatively low thickness (i.e., a few sheets of paper) because the risk of unintentional staple release cannot be eliminated.

SUMMARY OF THE INVENTION

It is accordingly an object of the invention to provide a stapler that overcomes the hereinafore-mentioned disadvantages of the heretofore-known devices of this general type and that can be optionally used for flat-clinch stapling or for external and/or internal stapling.

With the foregoing and other objects in view, there is provided, in accordance with the invention, a stapler, including an upper part having a thrust blade, an ejection channel and a magazine for guiding staples within the ejection channel under spring tension and for feeding the staples to the ejection channel, a staple located at the ejection channel thrust out of the ejection channel and through the material to be stapled by the thrust blade, a base plate connected to the upper part and a stapling plate having an upper side for receiving staple legs, the upper side having a slit-like perforation and shaped stampings for flat-clinch stapling, and disposed below the ejection channel, the stapling plate being selected from the group consisting of a rotating stapling plate, a sliding stapling plate and a divided stapling plate.

The object of the invention is achieved in that the stapling material support is a stapling plate of rotating or sliding or divided configuration and has shaped stampings on its upper side for receiving the staple legs.

In accordance with another feature of the invention, the stapling plate has projecting, shaped, outer gripping edges, and the gripping edges have shaped portions.

In accordance with a further feature of the invention, the stapler has a platform defining a guide groove attached to the base plate and the stapling plate has a C-shaped cross section and is guided by its mutually facing inner webs in the guide groove, the guide groove being closed on one side in the longitudinal direction and, thus, serving as a stop position for the stapling plate.

In accordance with an added feature of the invention, the stapling plate has two parts, one part being fixed and one part sliding or folding. In a preferred embodiment, the folding part has a hinge connection for external or internal stapling.

In accordance with an additional feature of the invention, the folding part can be locked in the functional and standby positions by a clip connection. The folding part can be pivotably connected to the base plate.

In accordance with yet another feature of the invention, the folding part is mounted on the base plate by an angled portion.

With the objects of the invention in view, there is also provided a stapler including an upper part having a thrust blade, an ejection channel and a magazine for guiding staples within the ejection channel under spring tension and for feeding the staples to the ejection channel, a staple located at the ejection channel thrust out of the ejection channel and through the material to be stapled by the thrust blade, a base plate connected to the upper part by a sliding pivoting mount and a stapling plate connected to the base plate for receiving staple legs and having a slit-like perforation and shaped stampings for flat-clinch stapling, and disposed below the ejection channel.

In accordance with another feature of the invention, the stapling plate is fixedly mounted on the base plate and the upper part with the magazine and the thrust blade is slidingly and pivotably mounted, the sliding pivoting mount being a connecting pivot and a bearing block having a slot, the bearing block being connected to the base plate, and the upper part being slidingly and pivotably mounted in the slot on the connecting pivot.

In accordance with a further feature of the invention, the upper part is mounted to be able to slide in a slot in the bearing block, the slot extending parallel to the underside of the base plate.

In accordance with an added feature of the invention, the upper part is connected to the base plate by a sliding connecting pivot.

In accordance with an additional feature of the invention, the length of the slot corresponds to the distance between the slit-like perforation and the shaped stampings.

Advantageously, the central distance between the end positions of the sliding connecting pivot corresponds to the central distance between the slit-like perforation and the stampings.

In accordance with yet another feature of the invention, the connecting pivot in the slot has at least two latching positions and a latching member, preferably a latching spring, configured to retain the connecting pivot in the selected position in the slot.

In accordance with yet an added feature of the invention, the base plate is connected to the upper part by a yaw pivot bearing for pivotally moving the upper part with respect to the base plate. The slit-like perforation and the shaped stampings are in line with each other and the pivoting travel of the upper part in the region of the ejection channel is adapted to engage the thrust blade and both the slit-like perforation and the shaped stampings with a staple.

In accordance with yet a further feature of the invention, a horizontally pivotable bearing block receives the upper part, the pivot travel of the upper part in the region of the ejection channel being adapted to the slit-like perforation and the shaped stampings, which are flush with one another.

In accordance with yet an additional feature of the invention, the bearing block can be raised from each latching position in order to pivot it. For latching in the respective position, corresponding latching members are configured on the lower side of the bearing block and on the upper side of the base plate.

In accordance with a concomitant feature of the invention, the bearing block is pivoted about a pivot bearing disposed on the base plate.

Other features that are considered as characteristic for the invention are set forth in the appended claims.

Although the invention is illustrated and described herein as embodied in a stapler, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
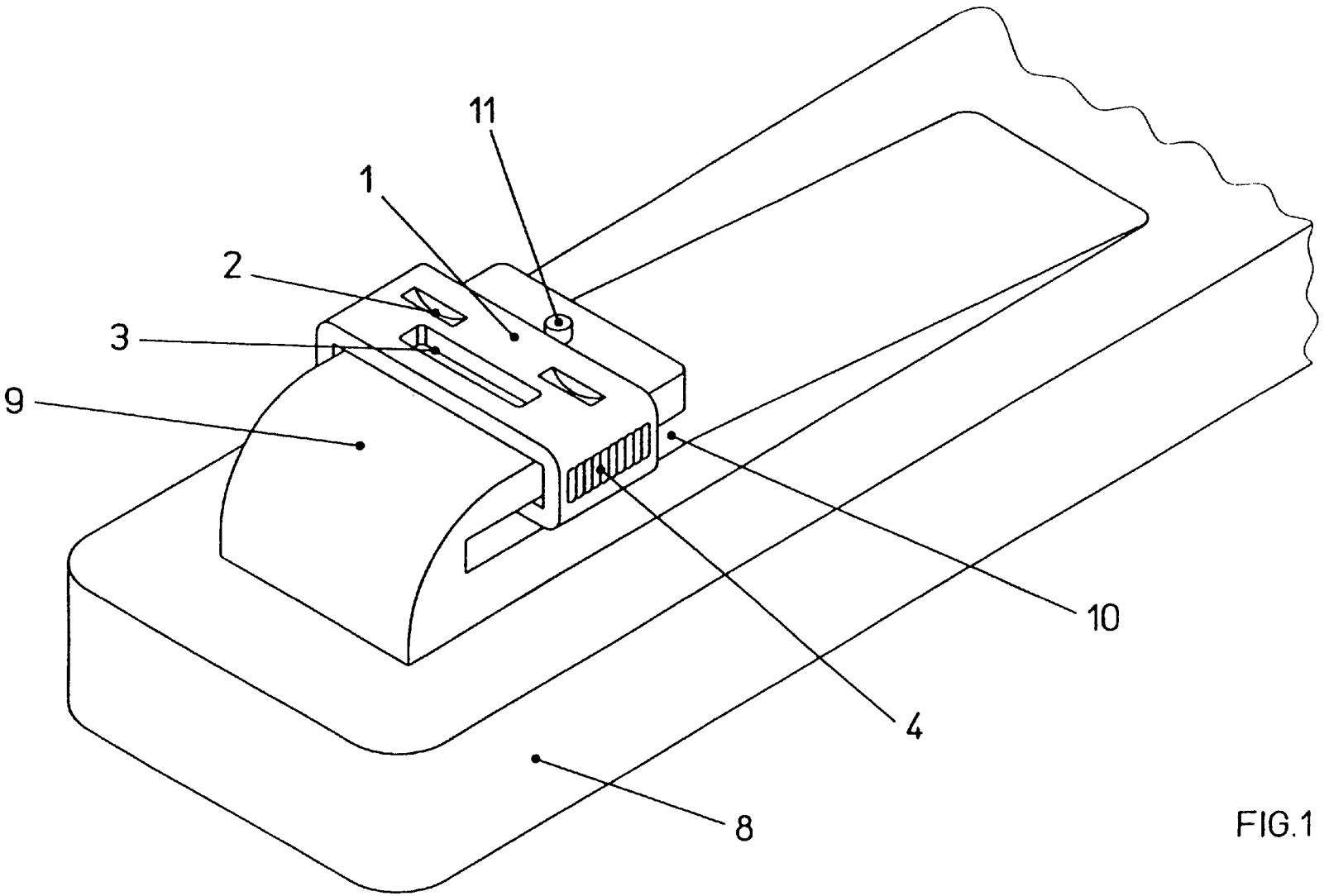
FIG. 1 is a fragmentary, perspective view of a sliding stapling plate disposed on a base plate according to the invention.

In all the figures of the drawing, sub-features and integral parts that correspond to one another bear the same reference symbol in each case.

Referring now to the figures of the drawings in detail and first, particularly to FIG. 1 thereof, there is shown a platform 9 for receiving a stapling plate 1 disposed on a stapler base plate 8. The stapling plate 1 has a double stamping 2 for an external stapling and a slit-like perforation 3 for flat-clinch stapling. The stapling plate 1 has gripping edges 4 having a shaped portion for improved handling when sliding the stapling plate 1 into the desired functional position. A guide groove 10 is closed at the front side of the stapler and, thus, forms a stop limitation for the stapling plate 1. The equivalent stop limitation on the other side, towards the rear side of the stapler, is a stop pin 11.

Figure 2:
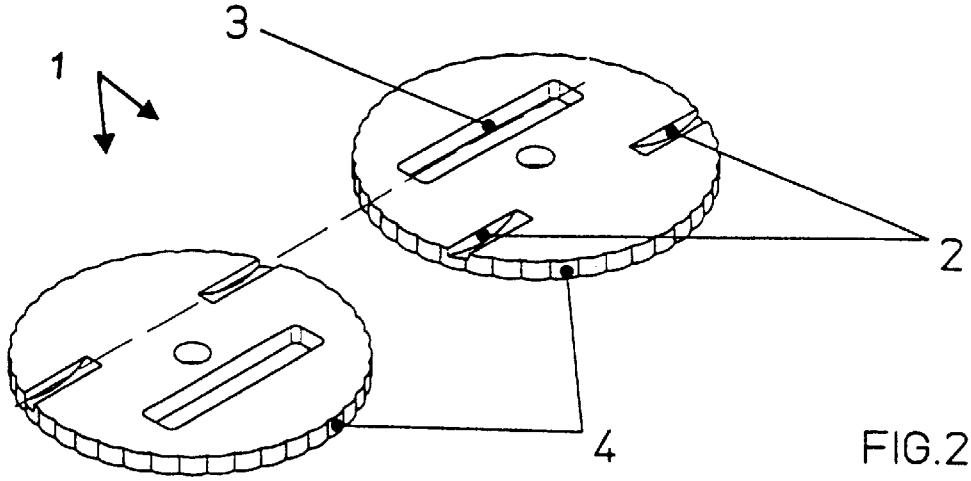
FIG. 2 is a perspective view of a rotating stapling plate in two rotated positions.
Figure 3:
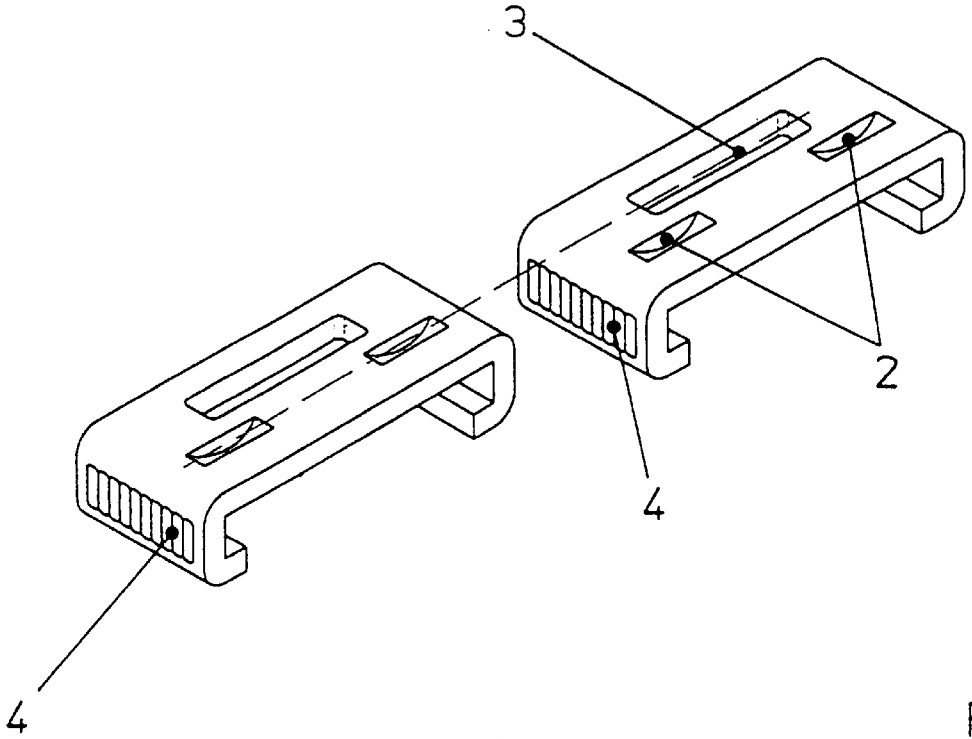
FIG. 3 is a perspective view of a sliding stapling plate in two positions.

In comparison to the stapling plate 1 of FIG. 1 that can be slid into the respective working position, a twistable stapling plate 1 is shown in FIG. 2.

Figure 4:
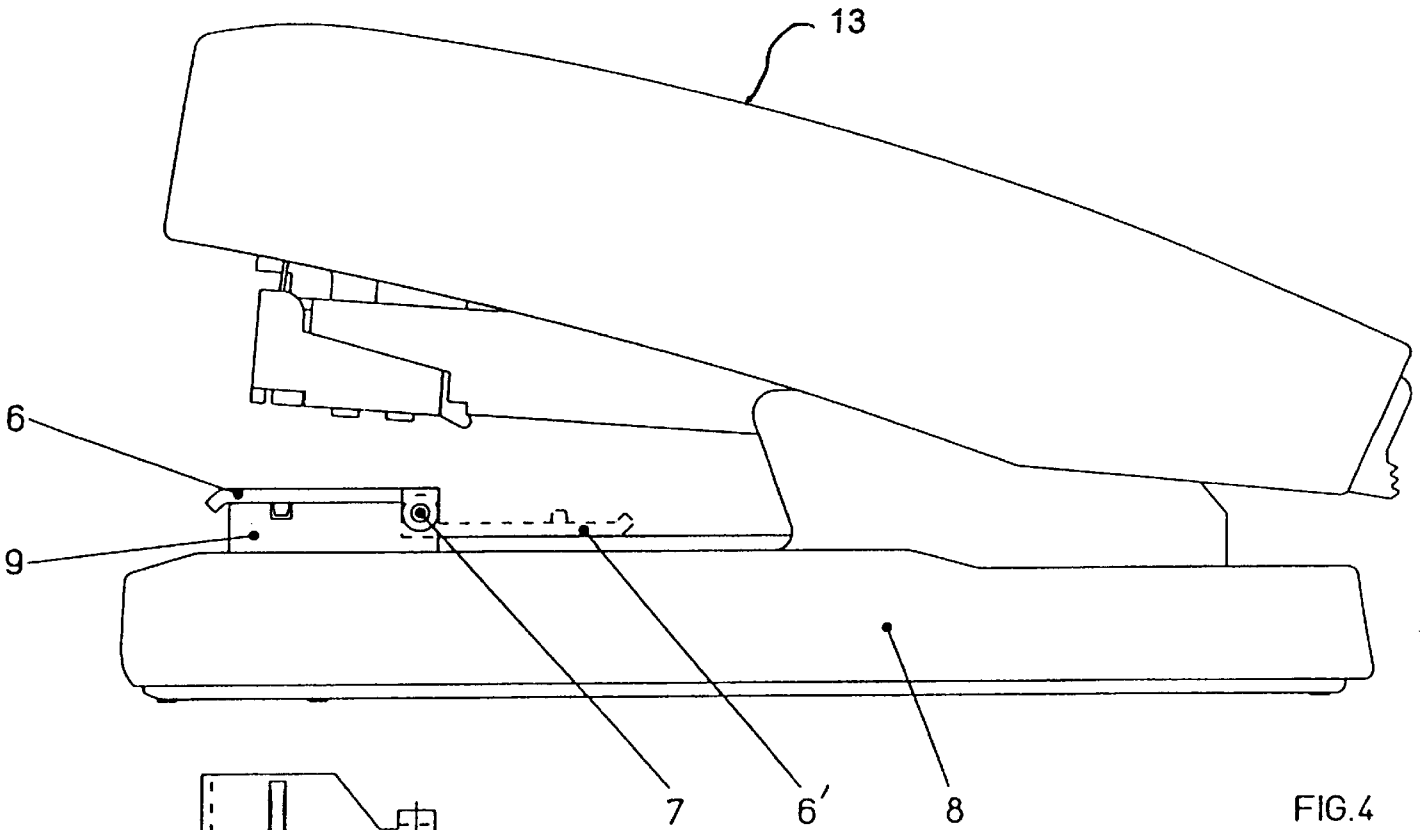
FIG. 4 is a side view of a stapler having a folding stapling plate for needle-type stapling.
Figure 5:
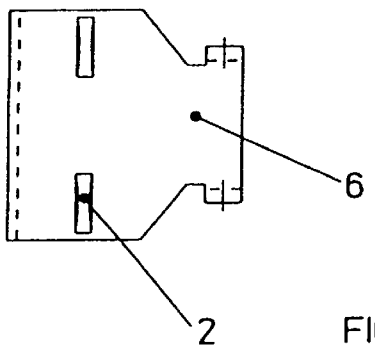
FIG. 5 is a plan view of a folding stapling plate for needle-type stapling.
Figure 6:
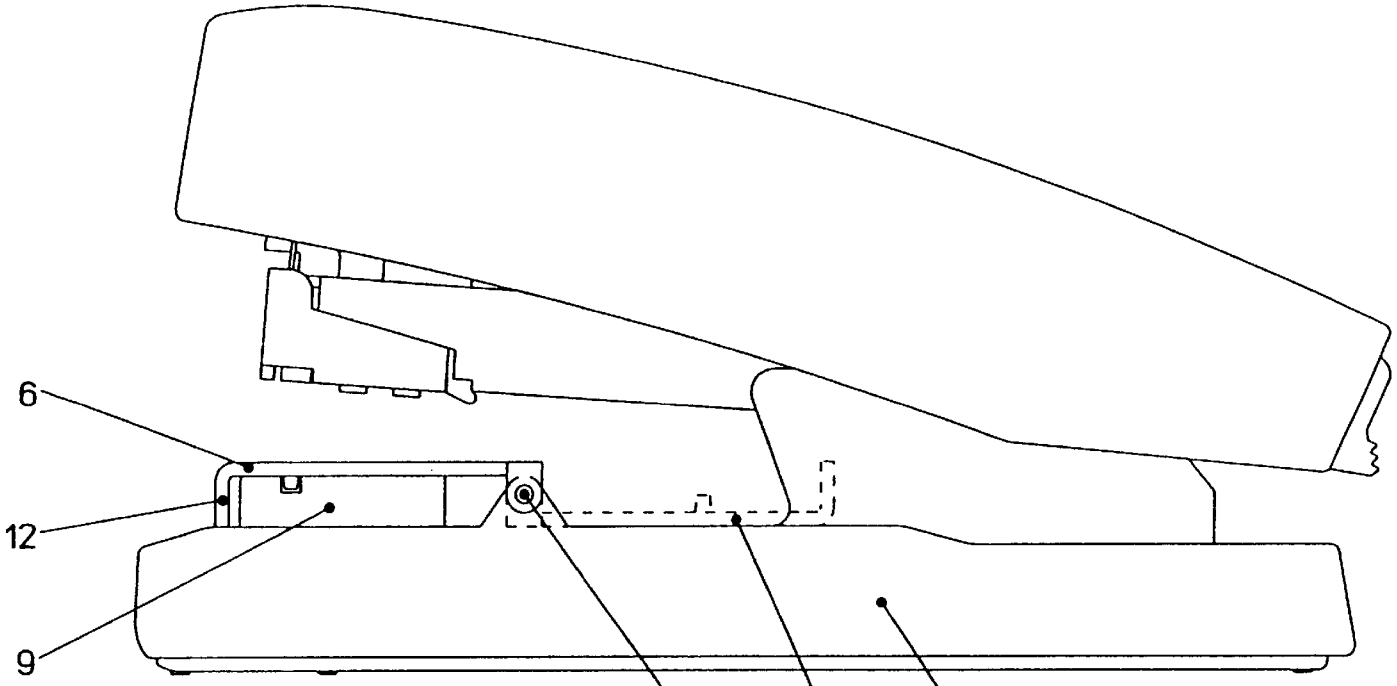
FIG. 6 is an alternative embodiment of FIG. 4, with a front angled portion of the folding stapling plate for needle-type stapling and an articulated connection on the base plate.
Figure 7:
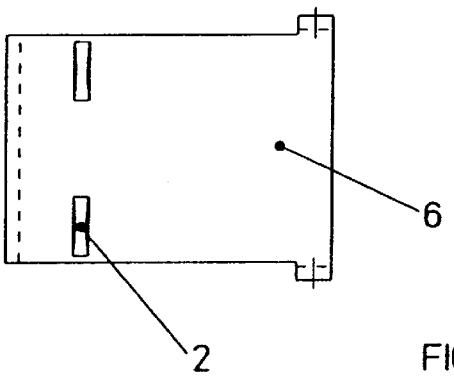
FIG. 7 is a plan view of a folding stapling plate according to FIG. 6.

An alternative embodiment of a two-part stapling plate 1 is shown in FIGS. 6 and 7. The stapling plate 1 part having the slit-like perforation 3 is the platform 9. The stapling plate 1 part having the stampings 2 (folding part 6) folds up into the stapler. The folding part 6 of the stapling plate 1 is connected to a hinge 7. FIG. 5 shows a first embodiment of the folding part 6 and FIG. 7 shows a second embodiment. FIG. 4 applies the first embodiment of the folding part 6 to a stapler and FIG. 6 applies the second. The folding part 6, in the flat-clinch stapling embodiment, is folded up inside the stapler in a standby position 6' (shown in dashed lines). For stapling with the stampings 2, also referred to as the functional position, the folding part 6 is folded out of the stapler onto the platform 9 of the stapling plate 1. Flat-clinch stapling is not possible in the folded out functional position. The folding part 6 can be locked in the respective functional and standby positions by a non-illustrated clip connection. In FIG. 6, the folding part 6 is shown as having a front angled portion 12 that rests on the base plate 8.

Figure 8:
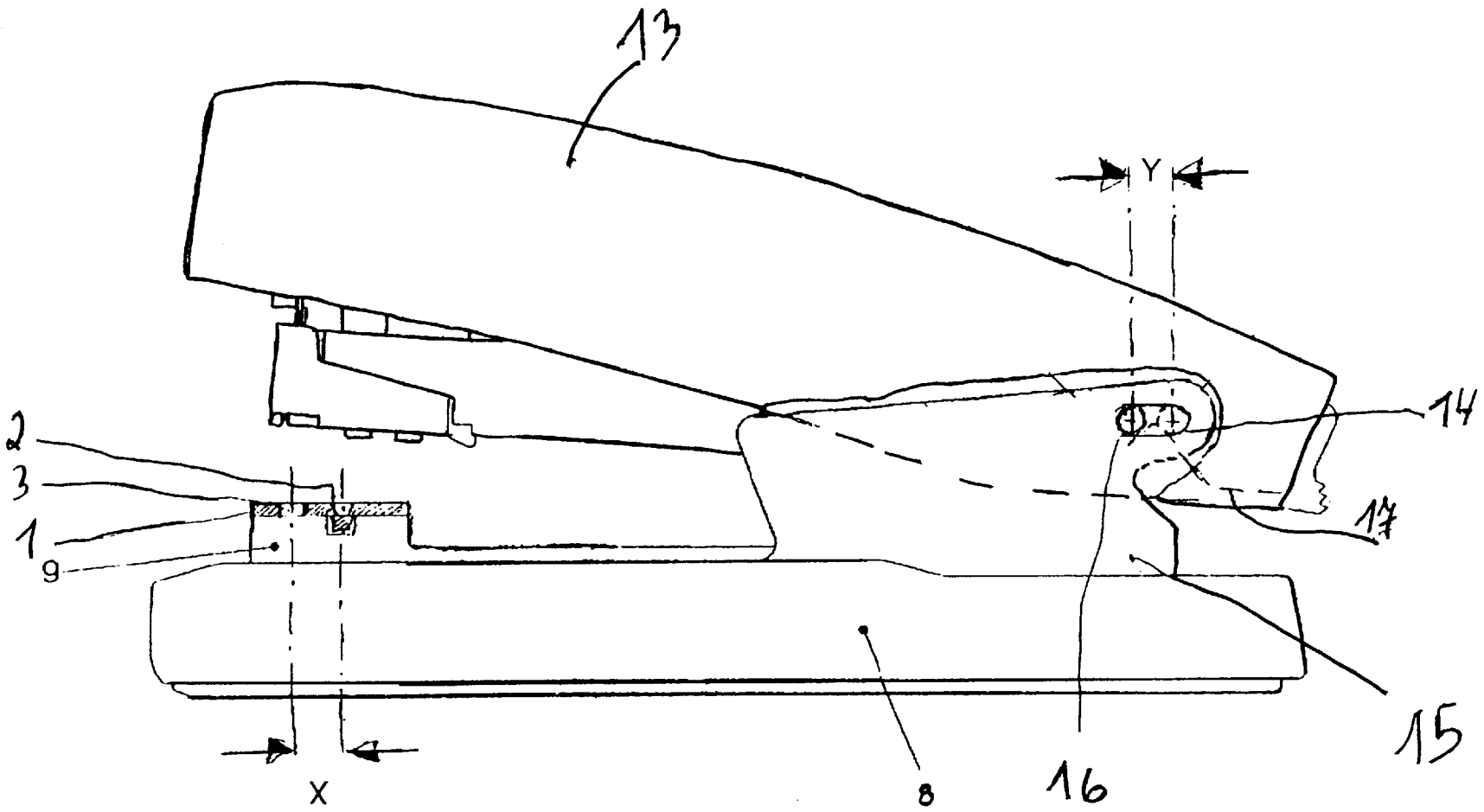
FIG. 8 shows a side view of a stapler with a sliding pivotable upper part.

Shown in FIG. 8 is a configuration where the stapling plate is stationary and fixed to the stapler base plate 8 and the stapler upper part 13 moves for changing from one stapling position to another. According to FIG. 8, the stapler upper part 13, having the stapler's magazine and thrust blade, is pivotably mounted in a slot 14 of a bearing block 15. The slot 14 extends parallel to the underside of the base plate 8. The upper part 13 is connected to the base plate 8 by a sliding pivot 16. A distance Y between the end positions of the sliding connecting pivot 16 corresponds to a distance X between the slit-like perforation 3 and the stampings 2. A latching member in the form of a latching spring 17 is configured to retain the connecting pivot 16 within a position in the slot 14 as selected by the user. When the stapler upper part 13 is in the rearmost position, the magazine and the thrust blade engage the stampings 2. When the stapler upper part 13 is in the front-most position, the magazine and the thrust blade engage the slit-like perforation 3.

Figure 9:
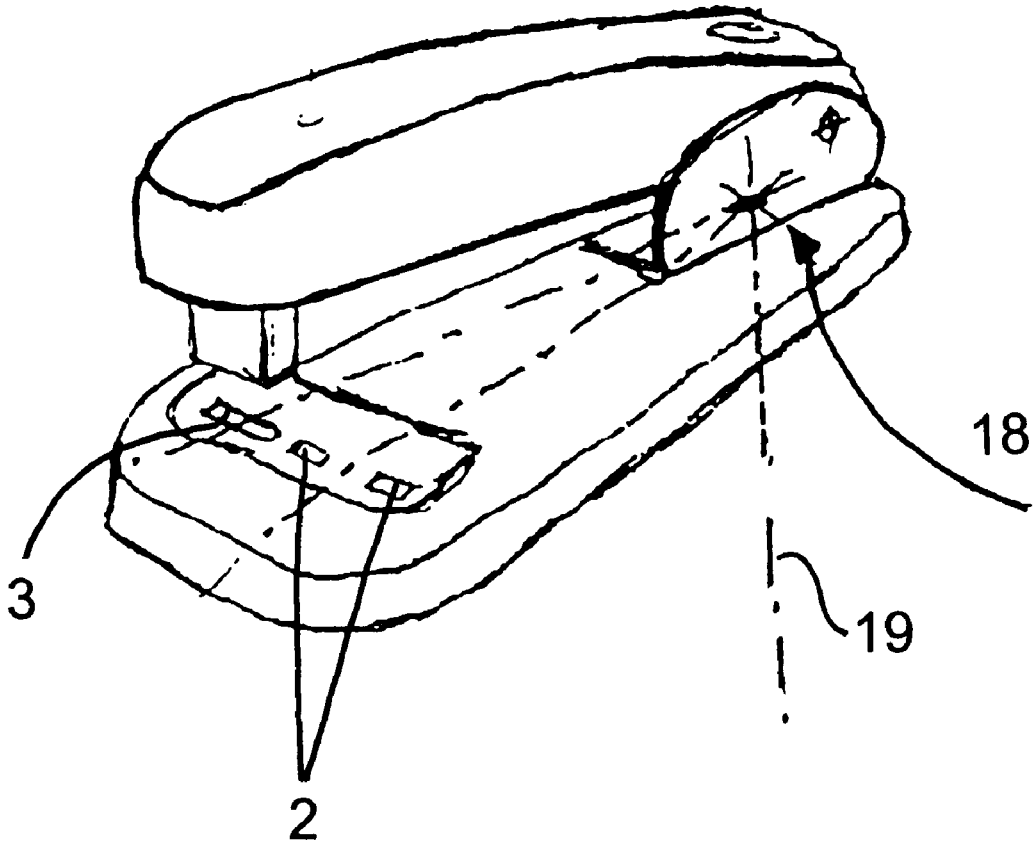
FIG. 9 is a perspective view of a stapler with a horizontally pivoting upper part.

Shown in FIG. 9 is an alternative configuration where the stapling plate is stationary and fixed to the stapler base plate 8 and the stapler upper part 13 pivotably moves for changing from one position to another. According to FIG. 9, the bearing block 15 for receiving the upper part 13, holding the magazine and the thrust blade, is configured to pivot substantially horizontal about a yaw axis 19. The slit-like perforation 3 and the stampings 2 are in line with one another. The pivoting travel of the upper part 13 in the region of the ejection channel is adapted to travel from the slit-like perforation 3 in one position to the stampings 2 in another position. The bearing block 15 is pivotably connected to the base plate 8, allowing the upper part 13 to pivot substantially horizontal about the yaw axis 19 on a pivot bearing 18.

We claim:

1. A stapler, comprising an upper part having a thrust blade, an ejection channel and a magazine for guiding staples within said ejection channel under spring tension and for feeding the staples to said ejection channel, a staple located at said ejection channel thrust out of said ejection channel and through the material to be stapled by said thrust blade;

a base plate having an upper surface, said base plate connected to said upper part; and a stapling plate having:

a top surface receiving staple legs;

a bottom surface;

a slit-like perforation for flat-clinch stapling, said perforation extending through said stapling plate from said top surface to said bottom surface, said perforation closed by said upper surface of said base plate;

shaped stampings for at least one of internal and external stapling;

said perforation and said stampings disposed below said ejection channel; and said stapling plate being selected from the group consisting of a rotating stapling plate, a sliding stapling plate and a divided stapling plate.

2. The stapler according to claim 1, wherein said stapling plate has projecting outer gripping edges.

3. The stapler according to claim 2, wherein said gripping edges have shaped portions.

4. The stapler according to claim 1, including a platform defining a guide groove attached to said base plate, said stapling plate having a C-shaped cross section and mutually facing inner webs and being guided on said platform in said guide groove by said inner webs.

5. The stapler according to claim 4, wherein said platform has a front side and is closed on said front side to stop said stapling plate from sliding in said guide groove past said front side.

6. The stapler according to claim 1, wherein said stapling plate is a two-part stapling plate.

7. The stapler according to claim 6, wherein said two-part stapling plate has a first fixed part and a second part being selected from the group consisting of a sliding part and a folding part.

8. The stapler according to claim 7, wherein said second part is a folding part pivotably connected to said first fixed part.

9. The stapler according to claim 7, wherein said second part is a folding part pivotably connected to said base plate.

10. The stapler according to claim 9, wherein said folding part has an angled portion and is mounted on said base plate by said angled portion.

11. A stapler, comprising:

an upper part having a thrust blade, an ejection channel and a magazine for guiding staples within said ejection channel under spring tension and for feeding the staples to said ejection channel, a staple located at said ejection channel thrust out of said ejection channel and through the material to be stapled by said thrust blade;

a base plate having an upper surface, said base plate connected to said upper part by a sliding pivoting mount; and a stapling plate connected to said base plate for receiving staple legs, said stapling plate having:

a top surface;

a bottom surface;

a slit-like perforation for flat-clinch stapling, said perforation extending through said stapling plate from said top surface to said bottom surface, said perforation closed by said upper surface of said base plate;

shaped stampings for at least one of internal and external stapling; and said perforation and said stampings disposed below said ejection channel.

12. The stapler according to claim 11, wherein said sliding pivoting mount is a connecting pivot and a bearing block having a slot, said bearing block is connected to said base plate, and said upper part is slidingly and pivotably mounted in said slot on said connecting pivot.

13. The stapler according to claim 12, wherein said base plate has an underside and said slot extends parallel to said underside.

14. The stapler according to claim 12, wherein said slit-like perforation and said shaped stampings are spaced apart at a distance and said slot has a length corresponding to said distance between said slit-like perforation and said shaped stampings.

15. The stapler according to claim 12, wherein said slit-like perforation and said shaped stampings are spaced apart at a first central distance and said connecting pivot has two end positions spaced apart at a second central distance corresponding to the first central distance between said slit-like perforation and said shaped stampings.

16. The stapler according to claim 11, wherein said sliding pivoting mount has a slot and at least two latching positions in said slot.

17. The stapler according to claim 11, including a latching member, said sliding pivoting mount having a slot and said latching member retaining said sliding pivoting mount in at least one selected position in said slot.

18. The stapler according to claim 17, wherein said latching member is a latching spring.

19. The stapler according to claim 11, wherein said base plate is connected to said upper part by a yaw pivot bearing for pivotally moving said upper part with respect to said base plate.

20. The stapler according to claim 19, wherein said slit-like perforation and said shaped stampings are in line with each other and a pivoting travel of said upper part in a region of said ejection channel is adapted to engage said thrust blade and both said slit-like perforation and said shaped stampings with a staple.

21. The stapler according to claim 19, including two corresponding latching members, said base plate having an upper side, said yaw pivot bearing having a bearing block, a first of said latching members being disposed on said upper side of said base plate and a second of said latching members being disposed on said bearing block.

22. The stapler according to claim 21, wherein said bearing block is pivotable about said yaw pivot bearing with respect to said base plate.

* * * * *